US005775200A

United States Patent [19]

Tsai

[11] Patent Number: 5,775,200

[45] Date of Patent: Jul. 7, 1998

[54] AIR PUMP

[75] Inventor: Peter Tsai, 3F, No. 16, Shi-Jei Street, Hsin-Chu City, Taiwan

[73] Assignee: Peter Tsai, Hsin-Chu City, Taiwan

[21] Appl. No.: 726,290

[22] Filed: Oct. 4, 1996

[51] Int. Cl.[6] ..... F01B 31/00

[52] U.S. Cl. ..... 92/58.1; 92/187

[58] Field of Search ..... 92/58.1, 187

[56] References Cited

U.S. PATENT DOCUMENTS

| | | | |
|---|---|---|---|
| 534,715 | 2/1895 | Hall | 92/58.1 |
| 1,490,553 | 4/1924 | Barthel | 92/187 |
| 2,200,012 | 5/1940 | Russell et al. | 92/58.1 |
| 3,765,307 | 10/1973 | Neel | 92/187 |
| 5,433,136 | 7/1995 | Lung-Po | 92/58.1 |

FOREIGN PATENT DOCUMENTS 82213102 9/1982 Taiwan .

*Primary Examiner*—F. Daniel Lopez

*Attorney, Agent, or Firm*—Fenwick & West LLP

[57] ABSTRACT

An air pump consisting of a housing, a piston, a piston-rod, and a cover is disclosed. The housing is a open-top hollow cylinder which contains a lower portion of the piston-rod and the piston connected to the bottom end of the piston-rod. The housing is topped by the cover which has a circular hole located at the center so as to allow the piston-rod to pass through the cover into the housing. The piston is connected with the piston-rod in a manner that the piston can rotate around the connecting point to some small degree while remains connected with the piston-rod. This may prevent the deviation of the piston from the position perpendicular to the inner wall of the cylinder caused by the sway of the piston-rod when the piston-rod is moved up and down. In addition, a cavity is formed in the surface of the piston-rod near the top to retain a ball needle.

1 Claim, 5 Drawing Sheets

AIR PUMP

FIELD OF THE INVENTION

The present invention relates to an air pump and in particular to an air pump wherein a piston is connected to a piston-rod in a manner that may prevent the deviation of the piston from the perpendicular position to the inner wall of the cylinder due to the sway of the piston-rod when the piston-rod is moved up and down.

BACKGROUND OF THE INVENTION

As more and more ball games become popular nowadays such as football, basketball, and baseball, some of these balls require to be pumped up with air before use. However, some large scaled pumping machines are not practical for the general public both in terms of the capacity needed, the storing space required and the price charged. Small scaled air pumps thus prevail in the present market since they do not occupy as much as space those pumping machines do (they are only about 10–15 cm high), and weigh much lighter (they are made of plastic). In addition, these small scaled air pumps are more economical and easy to carry, such as the Taiwan Patent 82213102. However, 1. the piston of this type of air pumps is completely fixed onto the piston-rod. The diameter of the inner wall of the cover has to be greater than that of the piston-rod so as to allow air to enter the cylinder. The resulting gap causes the piston-rod to sway when the user moves the piston-rod up and down, which in turn causes the piston connected to it to deviate from the perpendicular to the inner surface of the cylinder. The resulting gap between the inner wall of the cylinder and the piston would produce air leakage. In the long term this would also result in the separation of O ring from the piston.
2. the piston-rod is a long and thin object made of plastic and such sway may cause the bending or damage of the piston-rod and the inclination of the piston.
3. a ball needle is required to connect between the air pump and a ball to be pumped when pumping air into the ball. The needle is easy to lose owing to its tiny size.

SUMMARY OF THE INVENTION

The present invention is therefore designed to overcome the afore-mentioned shortcomings.

It is a primary object of the present invention to provide an efficient air pump by improving the method that a piston is connected with a piston-rod. A piston is not fixed onto the piston-rod and instead is connected in a manner that a piston is allowed to rotate around the connecting point to some small degree. This may prevent the deviation of the piston from the position perpendicular to the inner wall of the cylinder resulting from the sway of the piston-rod when the piston-rod is moved up and down. This also may prevent the damage of the piston-rod.

It is the other object of the present invention to provide an air pump having a cavity in the surface of the piston-rod near the top for retaining a ball needle when it is not in use.

DETAILED DESCRIPTION OF THE EMBODIMENT

Figure 1:
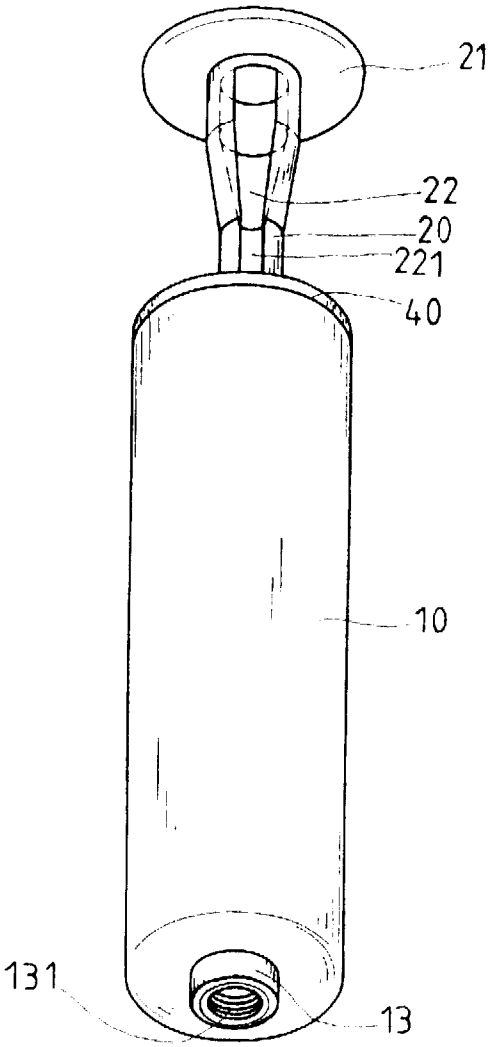
FIG. 1 is a perspective view of an air pump in accordance with the present invention.
Figures 2, 2A:
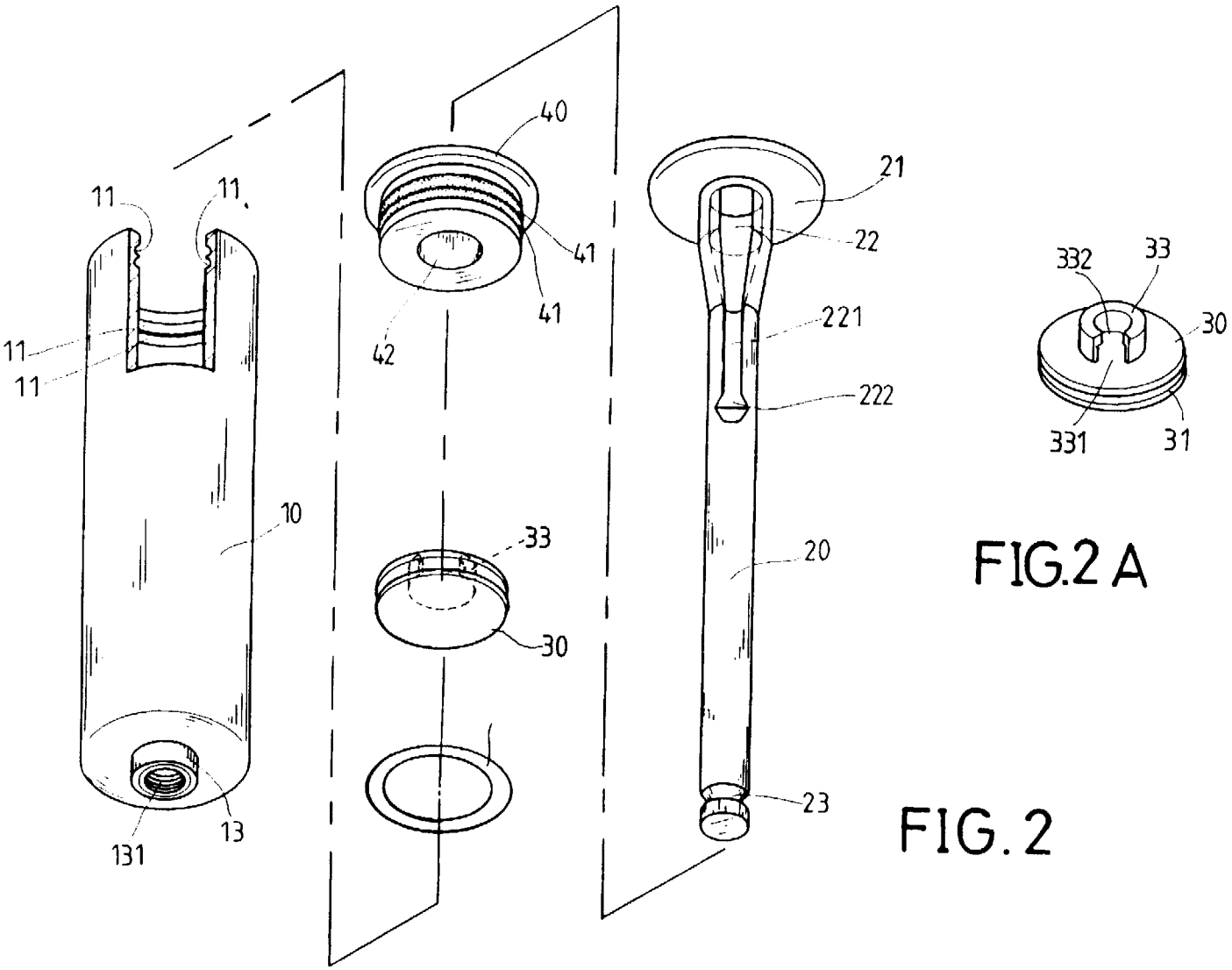
FIG. 2 is an exploded view of the air pump.
FIG. 2A is another perspective view of the piston in FIG. 2.

Referring to the drawings and in particular to FIG. 1, FIG. 2 and FIG. 2A, which show respectively a perspective view and an exploded view of an air pump according to the present invention, the air pump comprises a housing 10, a piston-rod 20, a piston 30, and a cover 40. The housing 10 which is a hollow cylinder is topped by the cover 40. The cover 40 has a circular hole at the center so that the piston-rod 20 can pass through the cover 40 into the cylinder. The piston 30 connected to the end of the piston-rod 20 is disposed within the cylinder.

Figure 3:
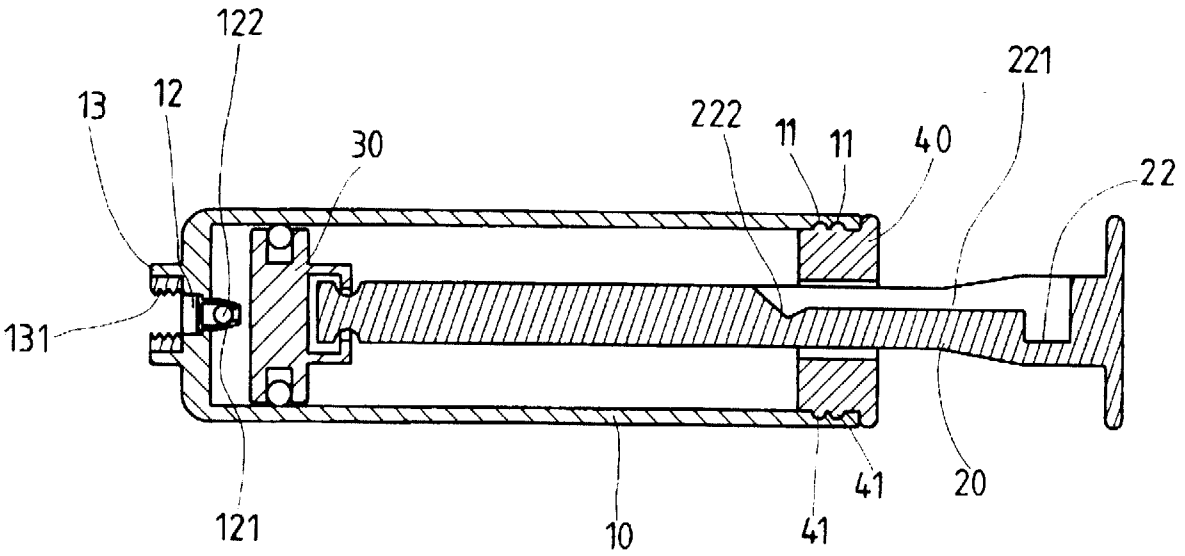
FIG. 3 is a cross-sectional view of the air pump.

Referring to FIG. 2 and FIG. 2A, the housing 10 is an open-top hollow cylinder. A plurality of spiral grooves 11 are provided on top portion of the inner surface of the housing 10, and an outlet 12 (as shown in FIG. 3) for air exit is provided at the closed end of the housing 10. A threaded fitting 13 for connecting a ball needle is projecting from the underside of the housing 10 to fit over the outlet 12. On the inner surface of the threaded fitting 13 are provided a plurality of threads 131 for screwing the ball needle into the threaded fitting 13. The inner surface of the threaded fitting 13 is made of metal so as to adapt itself to the metal ball needle to be screwed in and also to serve the purpose of prolonging the use of the threaded fitting 13, while the housing 10 is made of a plastic material. An outlet valve 121 is provided above the outlet 12 in the housing 10 with a ball 122 disposed inside, which controls the passage of air towards outside only.

The piston-rod 20 has a T-shaped cross-section and is longer than the housing 10 as shown in FIG. 3. The head 21 of the piston-rod 20 is a disc with the diameter greater than that of the piston-rod 20, which renders the present invention easy to grip and operate. The upper portion of the piston-rod 20, thicker than the lower portion, does not enter the housing 10 when the piston-rod 20 is pushed down. A cavity in the surface of the piston-rod 20, which is provided for retaining an idle ball needle, consists of two parts: a short cylindrical receptacle 222 of the upper portion of the piston-rod 20 and a guiding groove 221 of the lower portion. The diameter of the short cylindrical receptacle 22 is greater than that of the guiding groove 221, and more than ½ and less than ⅘ of the diameter of the head of a ball needle to be held within. Below the guiding groove 221 is located a hole 222 of sufficient dimensions in order to fit in a finger to draw the ball needle out of the cavity. The piston-rod 20 has a neck 23 near the bottom end so as to connect with the piston 30.

The shape of the piston 30 is similar to that of a disc, whose outer diameter is close to the inner diameter of the housing 10. A circular groove 31 is formed around the circumference of the piston 30 in order to receive an O ring 32 which is to seal the gap between the piston 30 and the inner wall of the housing 10. A C connector 33 for connecting with the piston-rod 20 is horizontally attached to the top of the piston 30. The inner diameter of the top rim 332 of the C connector 33 is less than the diameter of the piston-rod 20 and greater than that at the neck 23, while the hollow part 331 provides enough space for the bottom end of the piston-rod 20 below the neck 23 so that the piston can movably connect with the piston-rod 20.

The cover 40 is used to top the housing 10, with a plurality of spiral ridges 41 formed around the circumference of the cover 40 to be received by the corresponding spiral grooves 11 on the inner surface of the housing 10. The cover 40 has a circular hole 42 located at the center so that the piston-rod 20 can pass through the cover 40 into the housing 10 to connect with the piston 30. The inner diameter of the circular hole 42 is greater than the diameter of the piston-rod 20 so as to allow air to enter the housing 10.

The first step to assemble an air pump according to the present invention is to insert the bottom end of the piston-rod 20 through the circular hole 42 of the cover 40 and then to press the neck 23 of the piston-rod 20 into the hollow part 331 of the C connector 33 by machine for the piston-rod 20 is too thick to slide into the C connector 33. This may prevent the separation of the piston-rod 20 from the piston 30 and allow the piston 30 to sway in different direction. The connected piston 30 and piston-rod 20 are placed in the housing 10 and the cover 40 is pressed onto the top of the housing 10, where the spiral grooves 11 of the housing 10 interlock with the spiral ridges 41.

Figure 4:
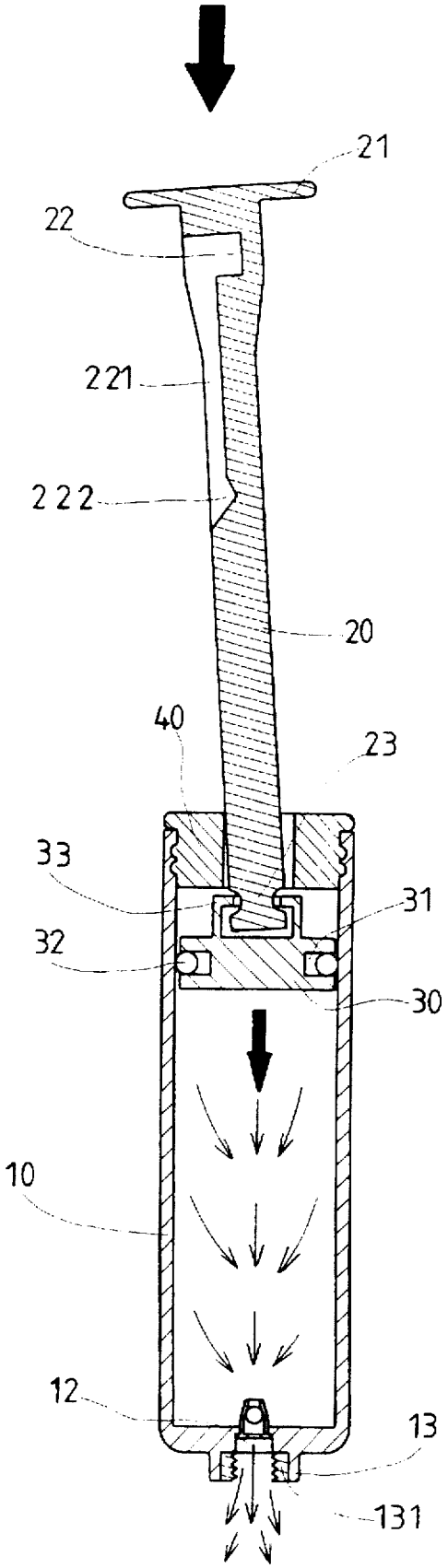
FIG. 4 is a cross-sectional view of the air pump, showing the inclination of the piston rod when the piston rod is pulled up.
Figure 5:
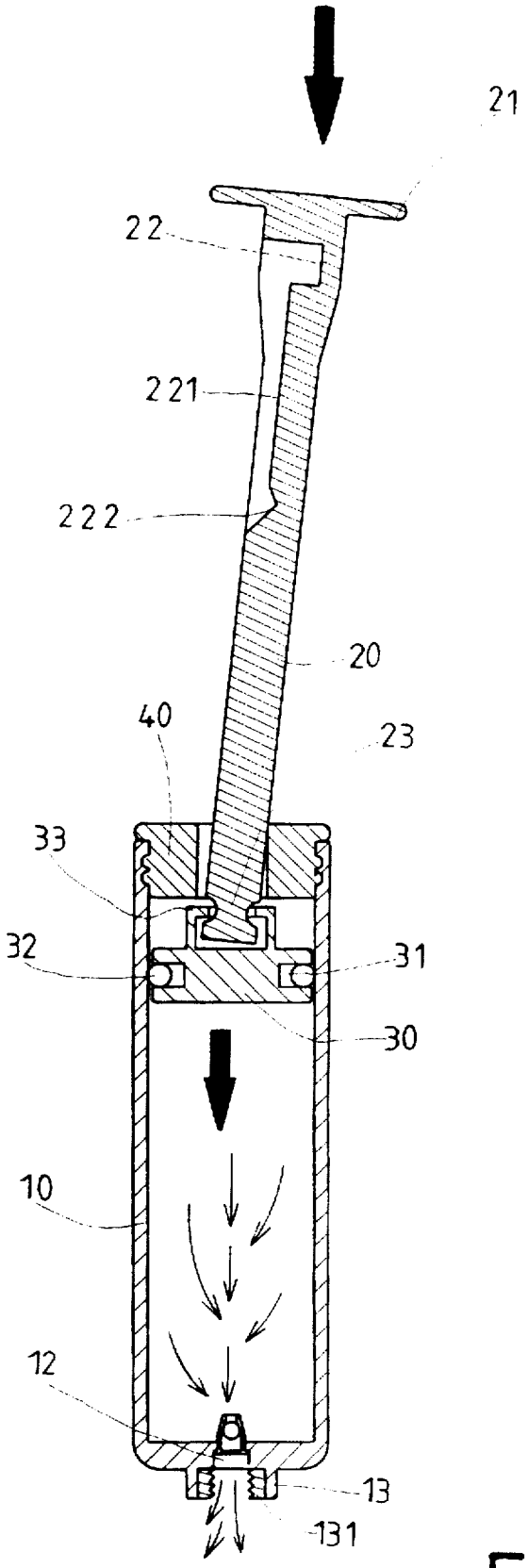
FIG. 5 is another cross-sectional view similar to FIG. 4.

Referring to FIG. 4 and FIG. 5, the piston-rod 20 would sway to the left (FIG. 4) or to the right (FIG. 5) when it is pulled up, owing to the gap between the piston-rod 20 and the inner wall of the cover; this occurs especially often when the capacity of an air pump is small and the piton-rod needs to be moved up and down with considerable frequency to fill up the cylinder. The present invention adopts a method of connecting the piston 30 and the piston-rod 20 which may prevent the above-mentioned shortcoming: the piston 30 is allowed to deviate from the position perpendicular to the piston-rod 20 for the connection between the piston 30 and the piston-rod 20 is not fixed. Therefore, the piston 30 would remain perpendicular to the inner wall of the housing 10, which is the position which produces least friction and provides an efficient way to pump up a ball.

It is to be understood that the form of the invention herewith shown an described is to be taken as a preferred example of the same and that various changes in the shape, size, and arrangement of parts may be resorted to, without departing the spirit of the invention or scope of the accompany claim.

What is claimed is:

1. An air pump comprising a housing of hollow cylinder having an open top, through which a piston is movably received in the housing, a cover fastened on the open top of the housing with a central circular hole formed therein, a piston-rod extending into the housing through the central circular hole in the cover and having a lower portion for connection to a piston to be movable in unison therewith, the piston-rod having a bottom end with a recessed neck formed near the bottom end thereof, a piston slidably movable within the cylinder and having a C connector horizontally attached on top for connection with the piston rod, the C connector comprising a hollow part to receive the bottom end of the piston-rod and a rim to receive and engage the neck of the piston-rod so as to connect with the piston-rod in a movable manner that the piston may incline from a position perpendicular to the piston-rod while remaining connected with each other, the piston-rod having a top end remote from the bottom end and including a cavity near the top end thereof and including a short internal cylindrical receptacle, a guiding groove and a bottom hole being formed in a surface of the piston-rod in order to retain an idle ball needle having a head at an end of the ball needle, the internal diameter of the short cylindrical receptacle being greater than a dimension of the guiding groove, and more than ½ and less than ⅘ of the diameter of the head of the ball needle, the bottom hole being formed below the guiding groove in order for a finger to fit in and draw the ball needle put of the cavity.

* * * * *